US005700053A

United States Patent [19]

Downing

[11] Patent Number: 5,700,053

[45] Date of Patent: Dec. 23, 1997

[54] CUSHIONING AND PROTECTION APPARATUS FOR A CHAIR ARMREST

[76] Inventor: David Downing, 125 W. 400 North, Lindon, Utah 84042

[21] Appl. No.: 724,934

[22] Filed: Oct. 2, 1996

Related U.S. Application Data

[63] Continuation of Ser. No. 330,295, Oct. 27, 1994, abandoned.

[51] Int. Cl.[6] ..... A47C 27/00

[52] U.S. Cl. ..... 297/227; 297/411.23

[58] Field of Search ..... 297/219.1, 220, 297/227, 411.21, 411.23, DIG. 6; 5/663; 248/345.1

[56] References Cited

U.S. PATENT DOCUMENTS

| | | | |
|---|---|---|---|
| 1,471,716 | 10/1923 | Austin | 24/564 X |
| 1,763,024 | 6/1930 | Underhill et al. | 24/564 X |
| 1,804,841 | 5/1931 | Pedroli | 248/345.1 |
| 2,057,551 | 10/1936 | Bishop | 297/227 |
| 3,884,495 | 5/1975 | Petock | 248/345.1 X |
| 4,089,497 | 5/1978 | Miller et al. | 248/345.1 |
| 4,109,887 | 8/1978 | Wakeland, Jr. | 248/345.1 |
| 4,554,039 | 11/1985 | James | 5/663 X |
| 4,588,224 | 5/1986 | Hill, Jr. | 297/DIG. 6 X |
| 4,969,683 | 11/1990 | Wallace et al. | 297/219.1 X |
| 5,048,892 | 9/1991 | Ledbetter | 5/663 X |
| 5,175,897 | 1/1993 | Marra, Jr. | 5/663 X |
| 5,332,288 | 7/1994 | Coates | 297/227 X |
| 5,360,360 | 11/1994 | Peterson | 297/DIG. 3 |
| 5,429,416 | 7/1995 | Lofy | 297/411.23 |
| 5,437,071 | 8/1995 | Feigenbaum | 5/663 |
| 5,445,433 | 8/1995 | Avihod | 297/DIG. 6 X |
| 5,478,137 | 12/1995 | Olson et al. | 297/227 X |

FOREIGN PATENT DOCUMENTS

| | | | |
|---|---|---|---|
| 1267603 | 6/1961 | France | 297/219.1 |
| 858508 | 12/1952 | Germany | 297/220 |
| 1920529 | 10/1970 | Germany | 297/219.1 |
| 1316564 | 5/1973 | United Kingdom | 297/219.1 |

*Primary Examiner*—Peter M. Cuomo
*Assistant Examiner*—Anthony D. Barfield
*Attorney, Agent, or Firm*—Foster & Foster

[57] ABSTRACT

A cushioning and protection apparatus for a chair armrest includes a cushion body having a central cavity and an opening leading thereto. The opening is defined by a pair of jaw projections that are resiliently deformable to enlarge the opening to enable an armrest to be inserted into the central cavity. An attachment device secures the cushioning and protection device to the armrest. The device can easily be installed on and removed from a chair armrest with little effort. The cushioning apparatus is lightweight, easily transportable, and particularly suitable for use in outdoor seating environments.

6 Claims, 2 Drawing Sheets

CUSHIONING AND PROTECTION APPARATUS FOR A CHAIR ARMREST

CONTINUITY

This is a continuation of U.S. patent application Ser. No. 08/330,295, filed 27 Oct. 1994, now abandoned.

TECHNICAL FIELD

This invention relates to cushioning devices for chairs, and more particularly, to cushioning and protection devices for chair armrests.

BACKGROUND OF THE INVENTION

Devices for protecting and cushioning portions of chairs, such as chair seats, back rests, and armrests, have long been recognized. Various types of paddings and cushions have been attached to chairs to provide comfort and protection to persons seated in the chairs.

Chair pads and cushions are most commonly installed on indoor chairs, rather than outdoor chairs, because indoor chairs are protected from the environment. Significant problems are encountered when installing padding and cushioning on chairs intended for outdoor use. Adverse weather conditions, such as extreme heat, cold, sunlight, and moisture, serve to destroy such cushioning and padding devices in a short period of time.

A particularly significant problem is presented by permanently constructed outdoor seating for places such as outdoor sports stadiums and the like. Chairs for such stadiums must be solidly constructed to withstand the various types of punishment and hard use caused by people sitting in the chairs. Such outdoor seating must also be permanently mounted inside the arena and therefore must be designed to withstand all ranges of temperatures and all weather conditions, from freezing temperatures in the winter to extreme heat and sunlight in the summer. Accordingly, mounting permanent padding or cushions to outdoor seats is impractical because the padding will break down and be destroyed over time under adverse weather conditions.

One particular problem associated with the above-described outdoor chairs is that portions of the chairs, including the seat, backrest, and armrests, become extremely hot from exposure to the sun during the summertime. A person's shirt and pants may protect portions of the person's body from a hot seat and backrest. With respect to the armrests, however, the person sitting in the chair will most likely be wearing a short sleeve shirt. Thus, there is a significant risk that the person's arms will directly contact the sun-heated armrests.

BRIEF SUMMARY AND OBJECTS OF THE PRESENT INVENTION

It is a primary object of the present invention to provide a cushioning and protection apparatus for a chair armrest.

Another object of the present invention is to provide a portable cushioning and protection apparatus for a chair armrest.

Still another object of the present invention is to provide a cushioning and protection apparatus for a chair armrest that can easily be installed on and removed from the chair armrest.

Yet another object of the present invention is to provide a portable cushioning and protection apparatus that is lightweight.

Another object of the present invention is to provide a cushioning and protection apparatus for a chair armrest that is portable, installable on, and removable from a chair armrest in an outdoor arena.

Another object of the invention is to provide a cushioning and protection apparatus that includes a replaceable cover.

Still another object of the present invention is to provide a cushioning and protection apparatus for a chair armrest that thermally insulates the arm of a person sitting in the chair from the armrest structure.

Another object of the invention is to provide a cushioning and protection apparatus for a chair armrest that is installable on and removable from a chair armrest without the need of any tools or technical training.

A further object of the invention is to provide a cushioning and protection apparatus for a chair armrest that forms around and secures itself to the chair armrest.

The foregoing objects are achieved by a cushioning and protection apparatus for a chair armrest including a cushion body having a central cavity and an opening for accessing to the central cavity. The central cavity is sized to receive a portion of a chair armrest. The cushion body is made of a resilient, deformable material. The opening can be enlarged by resiliently deforming the material for insertion of the chair armrest into the central cavity. Thereafter, the memory of the resilient material causes the material to close around the chair armrest to hold the protection and cushioning apparatus in place about the armrest. A removable cover may be placed over the resilient material. The cover may include indicia, such as a team name, logo, or the like.

Other objects, features, and advantages of the application will become more apparent from the following detailed description of the invention with reference to the accompanying drawings.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 2:
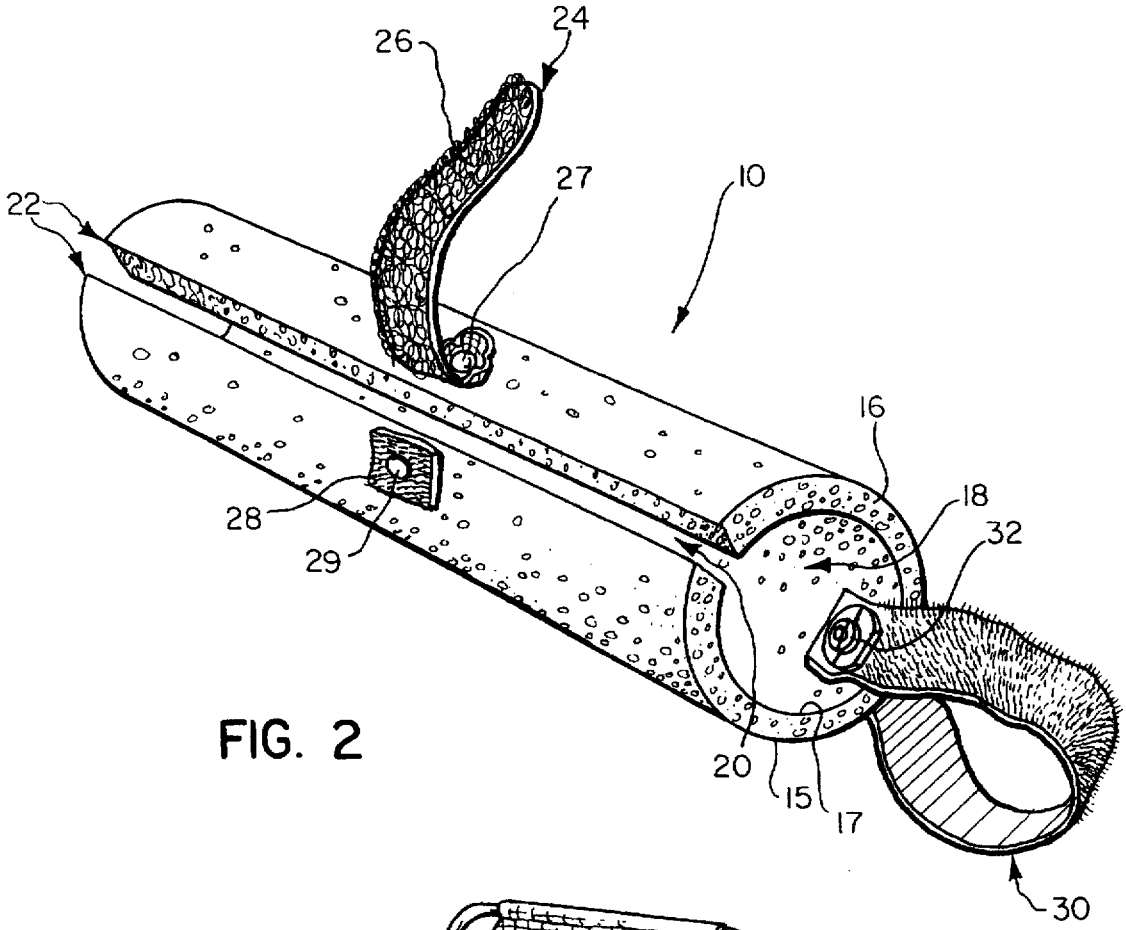
FIG. 2 is an enlarged isometric view of one cushioning and protection apparatus shown in FIG. 1.
Figure 1:
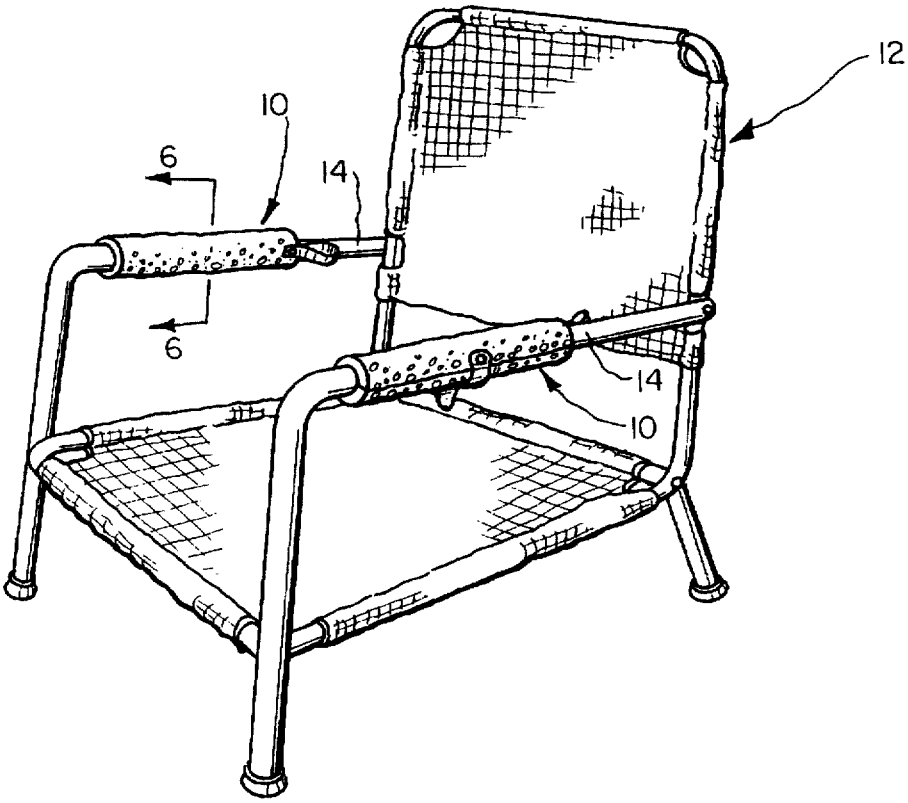
FIG. 1 is an isometric view of a chair including a pair of cushioning and protection apparatuses according to the present invention installed on the chair armrests.
Figure 6:
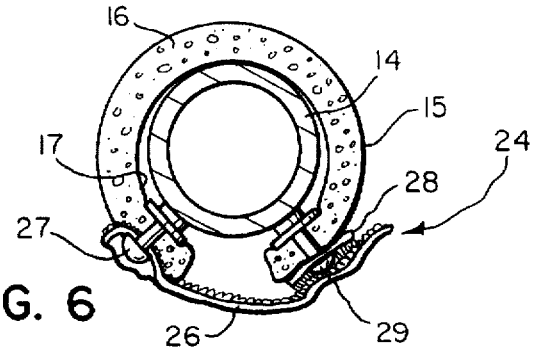
FIG. 6 is a sectional side elevation view of the cushioning and protection apparatus, taken along the line 6—6 of FIG. 1.

FIGS. 1, 2, and 6 show generally a cushioning and protection apparatus 10 for use in connection with a seat or chair 12. The cushioning and protection apparatuses according to the present invention are intended to be installed on armrests 14 of all types of chairs, particularly outdoor chairs, such as patio chairs, lawn chairs, beach chairs, stadium chairs, and the like. The cushioning and protection apparatus 10 generally includes a main cushion body 16 having an exterior facing surface 15 and an interior facing surface 17. The cushion body is preferably made of closed-cell foam, which may further include a skin layer on one or both of the exterior and interior facing surfaces 15, 17.

The cushion body 16 includes opposed ends, a length, and a longitudinal axis. The cushion body is substantially cylindrical in shape and defines a central cavity 18 aligned along the longitudinal axis. The central cavity is preferably sized to receive an armrest of a chair. The central cavity provides a continuous, uninterrupted passageway from one end of the cushion body to the opposite end.

The cushion body further defines a pair of opposed jaw projections 22 which extend from an apex, which has an axis parallel to the longitudinal axis, of the cushion body. The jaw projections 22 form an opening in the form of a slot 20 along one side of the cushion body 16. The jaw projections 22 are resiliently deformable and moldable around a chair armrest. Thus, the armrest can be of any cross-sectional shape. When installing the cushion body 16 onto a chair armrest, the jaw projections 22 are forcibly separated to expand the opening or slot 20. Thereafter, the armrest is inserted through the slot 20 and into the central cavity 18. Typically the foregoing is achieved by aligning the slot 20 with the armrest, forcing open the jaw projections 22, and forcing the cushion body over the armrest so that the cushion body surrounds the armrest. The memory of the resilient material then causes the jaw projections to close and hold the cushion body onto the armrest.

The cushioning body preferably is made of a resilient, formable material such as closed-cell foam. Alternatively, the cushioning body may be made of any other suitable material that can be formed about the armrest to provide protection and cushioning, and that can be secured in place about the armrest by an attachment device. Although the armrest and cushioning apparatus shown in FIGS. 1 and 2 are shown to be cylinder in shape, it is to be understood that the cushioning apparatus could specifically be made to correspond with any cross-sectional shape of armrest. As mentioned above, because of the resiliency of the material, the jaw projections 22 will form around virtually any cross-sectional shape of armrest.

The cushioning and protection apparatus 10 further includes a fastening device in the form of an attachment assembly 24. The attachment assembly preferably comprises a main portion 26 which includes a plurality of loops. The main portion is secured to the cushion body 16 by means of a conventional fastener 27. The attachment assembly also includes a base portion 28 comprising a plurality of hooks. The base portion is secured to the cushion body by means of a conventional fastener 29. The hooks and loops of the base and main portions, respectively, form a releasable attachment devise in the form of a VELCRO™ hook and loop fastening material type fastener. It is to be understood that other types of fastening devices could be used to maintain the protection and cushioning apparatus in operative position around the armrest.

The cushioning and protection apparatus 10 shown in FIGS. 1 and 2 still further comprises a tether or carrying strap 30 for transporting the device. The carrying strap is attached to one end of the cushioning body 16 by means of a conventional fastener 32. In the embodiment shown in FIG. 2, the carrying strap is in the form of a large loop, which may be used for securing the cushioning and protection device to a person's belt. Because the cushioning apparatus is extremely lightweight, it is easy to carry and use. No special tools, skills, or technical training are required to install or remove the cushioning and protection apparatus on a chair armrest. Most suitably, the cushioning apparatus 10 can be taken to any outdoor event stadium and installed on a chair armrest. The cushioning and protection apparatus will cushion the user's arms and insulate the user's arms from the temperature of the armrest (such as heat from sunlight or cold from low temperatures).

Figure 3:
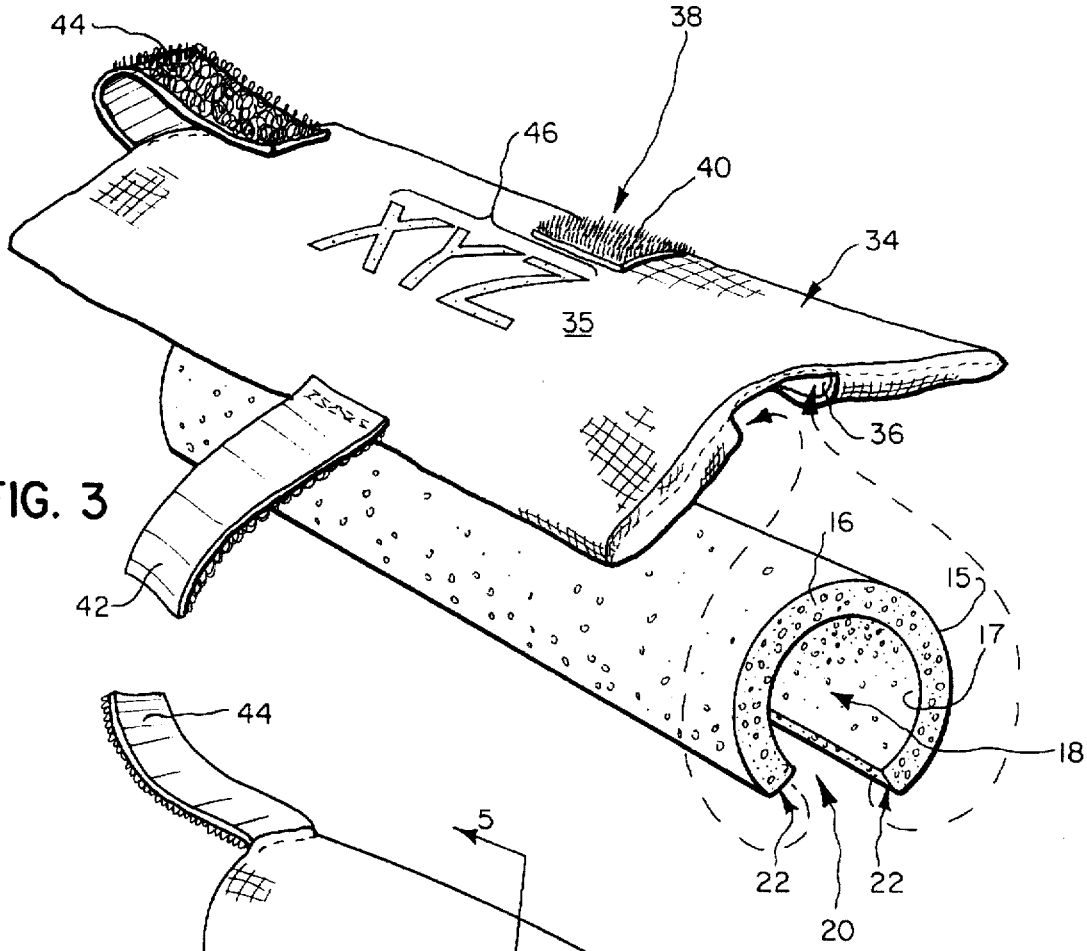
FIG. 3 is an isometric view of an alternative embodiment of a cushioning and protection apparatus for a chair armrest according to the present invention.
Figure 4:
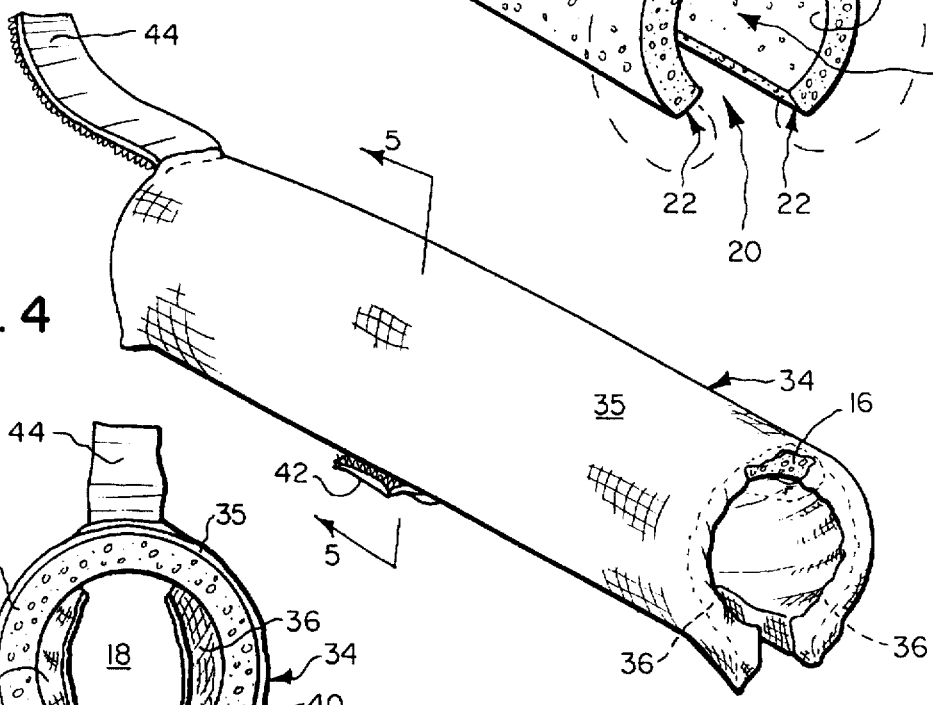
FIG. 4 is an isometric view of the cushioning and protection apparatus of FIG. 3 with a cover installed thereon.
Figure 5:
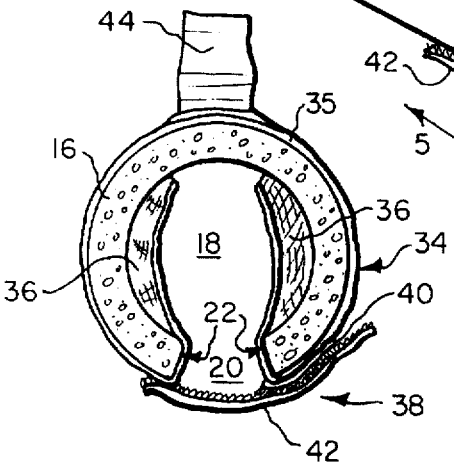
FIG. 5 is a sectional side elevation view of the cushioning and protection apparatus, taken along the line 5—5 of FIG. 4.

FIGS. 3–5 shows an alternative embodiment of the present invention. A main cushion body 16, similar to the cushion body 16 of FIGS. 1, 2, and 6, is shown. Specifically, the cushion body 16 shown in FIGS. 3–5 has the same properties as discussed in connection with the embodiment shown in FIGS. 1 and 2, including a central cavity 18 and a slot 20 formed by jaw projections 22 of the main cushion body 16.

The embodiment of FIGS. 3–5 further comprises a cover 34 disposed over the main cushion body 16. The cover includes a pair of pockets 36 for receiving the jaw projections 22 of the cushion body 16. The concept of using a cover over the cushion body 16 enables a user to install and remove various covers. The covers to be cleaned between uses. In addition, the covers can be advantageously used in marketing or promoting a particular team. Various types of indicia 46 can be placed on the covers. The indicia may comprise, for example, a particular team name, logo, or the like. Further, the cover may be made to suit a particular team color. Although the indicia 46 is shown on the exterior surface 35 of cover 34, it is to be understood that the indicia could similarly be placed directly on the outer surface 15 of the cushion body 16 shown in FIGS. 1, 2, and 6.

Referring still to FIGS. 3–5, an attachment assembly 38 comprising a base portion 40 and a main portion 42 is coupled to the cover 34 to allow the protection and cushioning apparatus to be secured about a chair armrest. The base portion 40 includes a plurality of hooks and for attaching to a plurality of loops on the main portion 42. The base 40 and the attachment strap 42 are secured to the cover by any conventional means, such as by sewing.

The embodiment of FIGS. 3–5 further includes a tether or carrying strap 44 attached to one end of the cover. The carrying strap provides an area by which the entire cover and cushion body can be held and carried with relative ease.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A cushioning and protection apparatus for a chair armrest, comprising:

a cylindrical cushion body having a length and a longitudinal axis, the cushion body comprising a moldable, formable, resilient material;

central cavity formed in the cylindrical body to provide the cushion body with a tubular shape, the central cavity being adapted to receive a portion of a chair armrest;

a pair of opposing jaws formed in the cylindrical cushion body, the jaws forming an elongated opening into the central cavity, the jaws being closed due exclusively to the resilient material;

a cover including a pair of pockets into which the jaws of the cushion body age removably inserted, the cover being selectively placeable about and removable from the jaws of the cylindrical cushion body;

wherein the cylindrical cushion body is adapted to be formed about the chair armrest to protect and cushion a person's arm resting on the chair armrest;

a fastening device coupled to the cylindrical cushion body and adapted to secure the cylindrical cushion body to the chair armrest, the fastening device being attached to one of the jaws, the fastening device spanning the elongated opening and being secure to the opposed jaws in an overlapping manner when secured to the chair armrest;

the cylindrical cushion body being adapted to allow a person to conveniently carry the cylindrical cushion body, the cylindrical cushion body further being adapted to enable rapid installment on and removal from the chair armrest.

2. A cushioning and protection apparatus according to claim 1, further comprising written indicia disposed on the cover.

3. A cushioning and protection apparatus according to claim 1, further comprising:

a strap coupled to the cover for carrying the cushioning apparatus.

4. A cushioning and protection apparatus for a chair armrest, comprising:

a cylindrical cushion body formed of resilient, semi-pliable foam, the cushion body having opposed ends, a length, and a longitudinal axis, the cushion body being tubular in shape due exclusively to the resilient, semi-pliable foam;

an elongated central cavity formed in the cylindrical cushion body along the longitudinal axis, the central cavity providing a continuous, uninterrupted passageway from one end of the cylindrical cushion body to another, the central cavity being adapted to receive a chair armrest;

opposed jaw projections defining a longitudinal slot along the length of the cylindrical cushion body, the jaw projections being closed due to the resilient, semi-pliable foam, the slot allowing the cylindrical cushion body to be adapted to be inserted over the chair armrest so that when the chair armrest is disposed within the central cavity, the cylindrical cushion body protecting and cushioning a person's arm supported by the armrest;

a fastening device coupled to the cylindrical cushion body and adapted to secure the cylindrical cushion body to the chair armrest, the fastening device being attached to one of the jaw projections, the fastening device spanning the longitudinal slot and being secured to the opposed jaw projections in an overlapping manner when secured to the chair armrest; and a cover including a pair of pockets into which the opposed jaw projections of the cushion body are removably inserted, the cover being selectively placeable about and removable from the jaw projections of the cylindrical body;

the cylindrical cushion body being sized to allow a person to conveniently carry the cylindrical cushion body, the cylindrical cushion body, further being sized to enable rapid installment on and removal from the chair armrest.

5. A cushioning and protection apparatus for a chair armrest, comprising:

a cylindrical cushion body having a length and a longitudinal axis, the cushion body comprising a resilient material;

a central cavity formed in the cylindrical cushion body to provide the cushion body with a tubular shape, the central cavity being adapted to receive a portion of a chair armrest;

a pair of opposing jaws formed in the cylindrical cushion body, the jaws forming an elongated opening into the central cavity, the jaws being closed due exclusively to the resilient material;

a covering including a pair of pockets into which the jaws of the cylindrical cushion body are removably inserted, the cover being selectively placeable about and removable from the jaws of the cylindrical cushion body, the cover further having an outside surface;

written indicia disposed on the outside surface of the cover;

wherein the cylindrical cushion body is adapted to be formed about the chair armrest to protect and cushion a person's arm resting on the chair armrest;

a fastening device coupled to the cylindrical cushion body and adapted to secure the cylindrical cushion body to the chair armrest, the fastening device being attached to one of the jaws, the fastening device spanning the elongated opening and being secured to the opposed jaws in an overlapping manner when secured to the chair armrest; and the cylindrical cushion body being adapted to allow a person to conveniently carry the cylindrical cushion body, the cylindrical cushion body further being adapted to enable rapid installment on and removal from the chair armrest.

6. A cushioning and protection apparatus for a chair armrest, comprising:

a substantially cylindrical cushion body having opposed ends, a length, a longitudinal axis, an exterior surface, and an interior surface;

the cushion body being formed of a resilient material comprising closed-cell foam and having a skin layer formed on both an exterior surface and an interior surface of the cushion body;

a central cavity formed longitudinally in the cylindrical cushion body to provide the cushion body with a tubular shape, the central cavity being substantially defined by the cushion body interior surface and adapted to receive a portion of the chair armrest;

a pair of resilient opposed jaw projections, the opposed jaw projections extending from an apex, the apex having an axis parallel to the longitudinal axis of the cylindrical cushion body;

a slot-like opening formed longitudinally in the cylindrical cushion body by the opposed jaw projections, the jaw projections being closed due exclusively to the resilient material;

a removable cover including pockets to receive the opposed jaw projections of the cylindrical cushion body, the removable cover having an exterior surface;

written indicia disposed on the cover exterior surface;

a fastening device attached to the cover, the fastening device spanning the slot-like opening when the cylindrical cushion body is positioned within the cover and secured to the armrest;

a strap attached to the cover to facilitate carrying the cylindrical cushion body and the cover.

* * * * *